US010314408B2

(12) United States Patent
Mascull et al.

(10) Patent No.: US 10,314,408 B2
(45) Date of Patent: Jun. 11, 2019

(54) CONTOURING DEVICE

(71) Applicant: ROGER THOMAS MASCULL AND ELIZABETH JOCELYN MASCULL AS TRUSTEES OF THE RT AND EJ MASCULL FAMILY TRUST, Allenton, Ashburton (NZ)

(72) Inventors: Roger Thomas Mascull, Ashburton (NZ); Bruce Gordon Mascull, Ashburton (NZ)

(73) Assignee: Roger Thomas Mascull and Elizabeth Jocelyn Mascull as Trustees of the RT and EJ Mascull Family Trust, Rolleston (NZ)

( * ) Notice: Subject to any disclaimer, the term of this patent is extended or adjusted under 35 U.S.C. 154(b) by 0 days.

(21) Appl. No.: 14/902,861

(22) PCT Filed: Jul. 4, 2014

(86) PCT No.: PCT/NZ2014/000136

§ 371 (c)(1),
(2) Date: Jan. 5, 2016

(87) PCT Pub. No.: WO2015/002551

PCT Pub. Date: Jan. 8, 2015

(65) Prior Publication Data

US 2016/0166080 A1 Jun. 16, 2016

(30) Foreign Application Priority Data

Jul. 5, 2013 (NZ) ..... 612914
Dec. 2, 2013 (NZ) ..... 618501

(51) Int. Cl.
*A47C 31/12* (2006.01)
*A47C 7/18* (2006.01)
(Continued)

(52) U.S. Cl.
CPC ..... *A47C 31/12* (2013.01); *A47C 7/021* (2013.01); *A47C 7/029* (2018.08); *A47C 7/14* (2013.01);
(Continued)

(58) Field of Classification Search
CPC ..... A47C 7/18; A47C 23/00; A47C 27/00; A47C 7/021; A47C 7/022; A47C 7/14;
(Continued)

(56) References Cited

U.S. PATENT DOCUMENTS 2,596,547 A * 5/1952 Guest ..... A47G 9/0207 5/485
4,628,557 A 12/1986 Murphy
(Continued)

FOREIGN PATENT DOCUMENTS

DE 296 21 191 U1 3/1997
DE 202 12 460 U1 1/2003
(Continued)

OTHER PUBLICATIONS

Supplementary European Search Report for EP Application No. EP 14 82 0689 dated Jan. 10, 2017 (7 pages).
(Continued)

*Primary Examiner* — Nicholas F Polito
*Assistant Examiner* — Amanda L Bailey
(74) *Attorney, Agent, or Firm* — Merchant & Gould P.C.

(57) ABSTRACT

The invention relates to a contouring device for a seat base, backrest, or mattress. The device comprises a substrate having a first surface and an opposing second surface, the first and second surfaces each comprising a plurality of pockets adapted to receive one or more inserts therein. Inserts of various sizes and shapes can be placed within selected pockets of the device to provide a contoured surface that suits the needs of the user of the device. For example,
(Continued)

the device can be adapted to provide contours that encourage a user to adopt a preferred posture when seated or lying down.

9 Claims, 7 Drawing Sheets

(51) Int. Cl.

| | |
|---|---|
| ***A47C 7/02*** | (2006.01) |
| ***A47C 7/14*** | (2006.01) |
| ***A47C 7/40*** | (2006.01) |
| ***A61G 5/10*** | (2006.01) |
| ***A61G 7/065*** | (2006.01) |
| ***A61G 7/07*** | (2006.01) |

(52) U.S. Cl.
CPC ..... *A47C 7/18* (2013.01); *A47C 7/40* (2013.01); *A47C 31/123* (2013.01); *A47C 31/126* (2013.01); *A61G 5/1043* (2013.01); *A61G 5/1045* (2016.11); *A61G 5/1048* (2016.11); *A61G 7/065* (2013.01); *A61G 7/07* (2013.01)

(58) Field of Classification Search
CPC ..... A47C 7/40; A47C 20/027; A47C 31/126; A47C 31/123; A47C 31/12; A47C 7/029; A47C 7/177; A47G 9/10; A61G 5/1043; A61G 5/1045; A61G 5/1048
See application file for complete search history.

(56) References Cited

U.S. PATENT DOCUMENTS

| | | | | |
|---|---|---|---|---|
| 4,682,818 | A | 7/1987 | Morell | |
| 4,753,480 | A | 6/1988 | Morell | |
| 5,016,303 | A * | 5/1991 | Tanaka | A47G 9/10 5/636 |
| 5,088,747 | A * | 2/1992 | Morrison | A61G 5/1043 297/219.1 |
| 5,452,488 | A | 9/1995 | Reinhardt | |
| 5,488,746 | A | 2/1996 | Hudson | |
| 5,687,436 | A | 11/1997 | Denton | |
| 6,615,568 | B1 | 9/2003 | Roskies | |
| 7,614,704 | B2 | 11/2009 | Whelan et al. | |
| 8,245,339 | B2 * | 8/2012 | Murray | A47G 9/10 5/657 |
| 8,678,418 | B1 * | 3/2014 | Quarles | A47C 31/11 280/304.1 |
| 2003/0140422 | A1 * | 7/2003 | Sama | A47C 31/00 5/658 |
| 2004/0019972 | A1 * | 2/2004 | Schecter | A47G 9/10 5/645 |
| 2006/0168735 | A1 * | 8/2006 | Tsay | A61G 5/1045 5/655.3 |
| 2006/0214484 | A1 * | 9/2006 | Zaharakos | A47C 31/11 297/218.1 |
| 2008/0178391 | A1 | 7/2008 | Andrade | |
| 2009/0139034 | A1 | 6/2009 | Maarbjerg | |
| 2009/0299442 | A1 * | 12/2009 | Vergona | A47G 9/0215 607/114 |
| 2011/0000018 | A1 * | 1/2011 | Kirchhoff | A47C 27/148 5/421 |
| 2013/0133138 | A1 | 5/2013 | Sugano et al. | |
| 2015/0189996 | A1 * | 7/2015 | Scarlett | A47C 27/081 5/722 |

FOREIGN PATENT DOCUMENTS

| | | | | |
|---|---|---|---|---|
| DE | 102004013674 | A1 | 10/2005 | |
| EP | 2502522 | | 10/2013 | |
| GB | 1176470 | | 1/1970 | |
| GB | 1295129 | | 11/1972 | |
| GB | 2410428 | A * | 8/2005 | A47C 27/001 |
| JP | 2000-5015 | A | 1/2000 | |

OTHER PUBLICATIONS

International Search Report for corresponding International Patent Application No. PCT/NZ2014/000136 dated Aug. 27, 2014 (3 pages).
First Examination Report from corresponding NZ Application No. 627075 dated Jul. 9, 2014 (2 pages).
First Examination Report from corresponding NZ Application No. 612914 dated Jul. 10, 2013 (2 pages).

* cited by examiner

CONTOURING DEVICE

This application is a National Stage Application of PCT/NZ2014/000136, filed 4 Jul. 2014, which claims benefit of Serial No. 612914, filed 5 Jul. 2013 in New Zealand and Serial No. 618501, filed 2 Dec. 2013 in New Zealand and which applications are incorporated herein by reference. To the extent appropriate, a claim of priority is made to each of the above disclosed applications.

FIELD OF INVENTION

This invention relates to a contouring device for use in seats, such as in a seat base or backrest, and for use in beds.

BACKGROUND

Contoured cushioning is commonly used for many different types of seats and mattresses. For example, contoured cushioning is sometimes used in seats, such as office chairs, wheelchairs, and vehicle seats to provide lumbar support and a comfortable seat base. Typically, contoured cushioning is provided by locating padding at specific parts of the seat base or backrest to create areas of greater or lesser cushioning and contouring. Contoured cushioning is sometimes used in seats, such as wheelchairs, to aid the comfort of the user and to help those with significant physical disabilities to sit comfortably and safely in a wheelchair. People with Cerebral Palsy, neuromuscular diseases, brain injuries, spinal injuries and many other medical conditions often need significant and customised contouring of seats to properly support their posture and positioning. The contouring required can be very user specific, with some people requiring different areas of the seat to be raised or lowered and to different extents. The required extent of contouring and the position of contoured areas of the seat may need to be regularly modified for some users. Unfortunately, many known seating systems do not provide contoured seating in which the extent and location of the contouring can be readily altered. It can also be difficult to obtain the full extent of contouring required for high needs users of seats, particularly wheelchairs. As a result, high needs users are prone to slipping into unsafe and/or uncomfortable positions in their seats so that caregivers must regularly adjust the position of the person in the chair. Contoured cushioning is also sometimes used in beds to reduce the risk of pressure injuries to those who are bedridden for long periods of time.

Furthermore, many contouring devices for seats and mattresses provide fixed contouring that cannot be altered to suit the needs of individual users over time. For example, it is often the case also that the same seat cannot be used to suit the different needs of another user. Consequently, these customised (and often expensive) seats may only be useful to one person for a short period of time.

It is an object of the present invention to provide a contouring device that goes at least some way towards overcoming the disadvantages of the prior art or that at least provides the public with a useful alternative to current contouring devices.

SUMMARY OF THE INVENTION

In a first aspect, the invention provides a contouring device for a seat base, backrest, or mattress, the contouring device comprising a substrate having a first surface and an opposing second surface, the first and second surfaces each comprising a plurality of pockets adapted to receive one or more inserts therein, and further comprising one or more inserts for placing within one or more of the pockets.

Preferably, the pockets are formed from an elasticated material.

Optionally, at least one pocket comprises substantially enclosed opposing ends and a gap is formed between the opposed ends of the pocket and within which the one or more inserts can be inserted to be held within the pocket. A strap may extend across at least a portion of the gap to further restrain the one or more inserts within the pocket.

Outer surfaces of the pockets located on the first surface form a first contouring surface and outer surfaces of the pockets located on the second surface form a second contouring surface. Preferably, the device further comprises a cushioning layer located on the first contouring surface of the substrate. Optionally, the cushioning layer has a back surface on which are provided a plurality of pockets being adapted to hold inserts therein. Preferably, the cushioning layer comprises one or more fasteners for removably attaching the cushioning layer to the substrate. Alternatively, or additionally, the cushioning layer comprises one or more fasteners for removably attaching the cushioning layer to a rear panel of a backrest, seat base, or bed.

In a preferred form, the contouring device is substantially enclosed within a cover. Preferably, the cover comprises a re-closable opening through which the one or more inserts can be added to or removed from the pockets of the substrate.

Preferably, the one or more inserts are formed from a cushioning material.

In a second aspect, the invention provides a backrest comprising a contouring device according to the first aspect of the invention.

In a third aspect, the invention provides a seat base comprising a contouring device according to the first aspect of the invention.

In a fourth aspect, the invention provides a mattress comprising a contouring device according to the first aspect of the invention.

In a fifth aspect, the invention provides a wheelchair in which the contouring device of the first aspect of the invention is provided in a backrest or seat base of the wheelchair, or both.

As used in this specification, the words "comprises", "comprised", "comprising", and similar words, are not to be interpreted in an exclusive or exhaustive sense. In other words, they are intended to mean "including, but not limited to".

The words "seat", "seats", "seating" and similar words, as used in this specification, refer to any type of seating, including but not limited to wheelchairs, office chairs, car seats, aircraft seats, couches, and lounge chairs.

The term "contact surfaces" as used in this specification should be interpreted to mean those surfaces that are intended to be contacted by a user of a seat or mattress comprising the device of the invention. For example the contact surface of a cover or cushioning layer is the surface on which the user sits, lies, or rests.

BRIEF DESCRIPTION OF IMAGES

Preferred embodiments of the invention will now be described by way of example only and with reference to the accompanying images, of which:

DETAILED DESCRIPTION

The invention provides a contouring device for a seat base or backrest of a seat or for a mattress. The device is adapted so that its contours can be altered to suit the postural support needs of a user sitting in the seat or to suit the needs of a user lying on a mattress, as the case may be.

The device comprises a substrate having a plurality of pockets. Each pocket is adapted to hold one or more inserts within it. One or more inserts of a selected size and shape are placed within one or more selected pockets to provide the device with a contoured surface that meets the user's needs. For example, by placing inserts within some pockets and not others and by placing different numbers or sizes of inserts within different pockets, it is possible to alter the contours of the device to modify the posture and/or position of a user sitting in a seat having a backrest or seat base comprising the device. In a preferred arrangement, both the seat base and backrest of a seat comprise a contouring device so that the contours of the seat base and backrest can be modified by the device.

Figure 6:
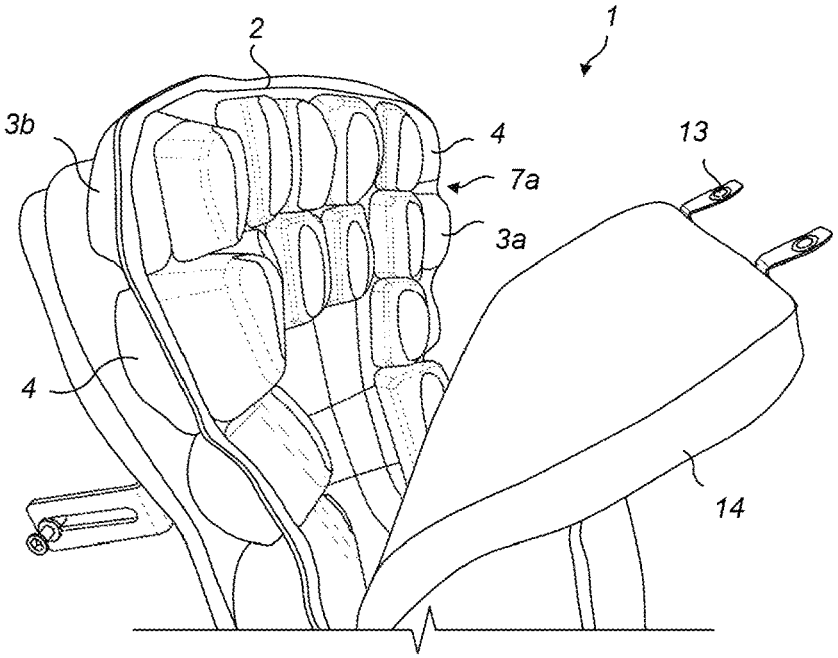
FIG. 6 is a front perspective view of one form of contouring device according to the invention in which a substrate having inserts within some of its pockets is placed between a rear panel of a backrest for a wheelchair and behind a cushioning layer.
Figure 7:
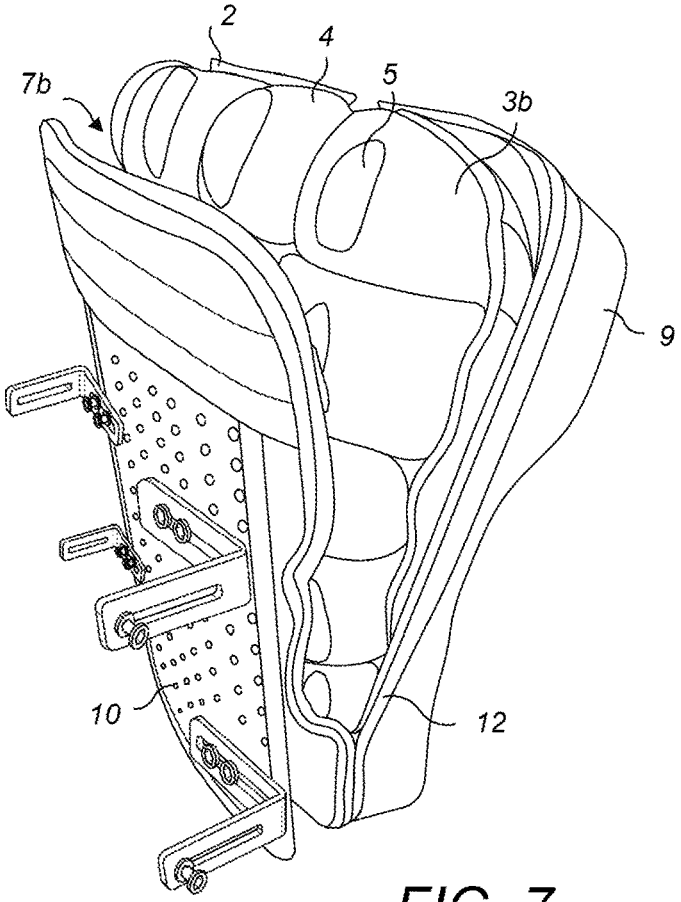
FIG. 7 is a rear perspective view of the device of FIG. 5 and further comprising a cover that is adapted to surround the substrate and cushioning layer.

As shown in FIGS. 1 to 7, the device 1 comprises a substrate 2 having a first surface 3*a* and an opposing second surface 3*b*. A plurality of pockets 4 are located on the first surface 3*a* of the substrate 2. In a preferred form, the substrate is formed of a flexible material and a plurality of pockets are located on each the first and second surfaces 3*a*, 3*b* of the substrate, as shown in FIGS. 6 and 7.

Each pocket 4 is adapted so that one or more inserts 5 may be held within the pocket. Each pocket also comprises at least one opening 6 through which one or more inserts 5 can be inserted into the pocket and removed from the pocket.

In one form, as shown in FIGS. 4 to 7, a fabric sheet covers each of the first and second surfaces 3*a*, 3*b* of the substrate 2. Each fabric sheet is bonded or otherwise attached to the substrate 2 at intervals to form one or more pockets 4. Each pocket 4 comprises at least one opening 6, which is formed in the respective fabric sheet between the attached zones that define the pocket 4.

Preferably, each fabric sheet comprises a stretchy, elasticated fabric so that each pocket opening 6 can expand to allow inserts 5 to be readily placed into and taken out of the pocket 4. The elasticated fabric also allows the pockets 4 to expand to allow different sizes, shapes, and thicknesses of inserts 5 to be placed into the pockets and to allow multiple inserts 4 to be placed within the pockets 5. In this embodiment, because the fabric that forms the pockets has a degree of stretch and flexibility (i.e. elasticity), the pockets 4 and pocket openings 6 bulge outwards when filled with inserts 5, as shown best in FIGS. 4 to 6.

In another embodiment, each pocket is in the form of an individual pocket that is attached to the substrate.

The pockets of the device may be of different sizes and shapes, provided that the pockets and selected inserts are of a shape that allows the inserts to fit within the selected pockets. It is preferable that the pockets are square or rectangular, but in other forms, the pockets may be of any suitable size or shape. For example, the pockets may be substantially oval, square, hexagonal, or of an irregular shape. Furthermore, if the contouring device is to be used in a backrest, one or more elongate pockets may extend laterally across at least part of the first and/or second surfaces toward one side of the substrate where that side will be located in the lower region of the backrest. These pocket(s) allow for elongate inserts to be fitted within the pocket(s) to provide lumbar support to a user.

In the embodiment shown in FIGS. 6 and 7, the pockets 4 are positioned on the first and second surfaces 3*a*, 3*b* of the substrate 2 and form a matrix of multiple rows and columns of pockets 4. However, in other forms of the invention, the pockets may be positioned in any suitable layout, which may be a regular or irregular arrangement of pockets. Some areas of the substrate may even be devoid of pockets.

Figure 1:
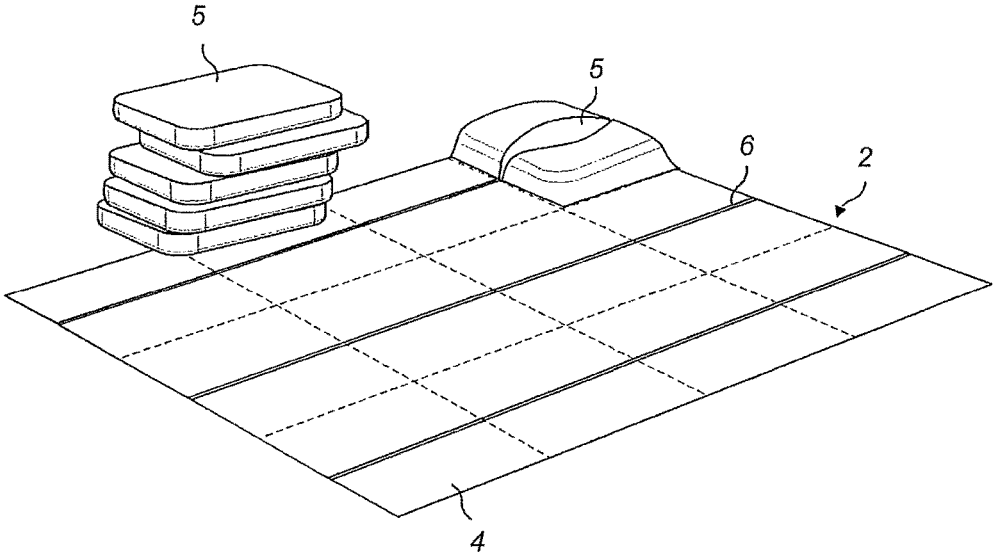
FIG. 1 is a schematic perspective view of one form of substrate for a contouring device according to the invention.
Figure 2:
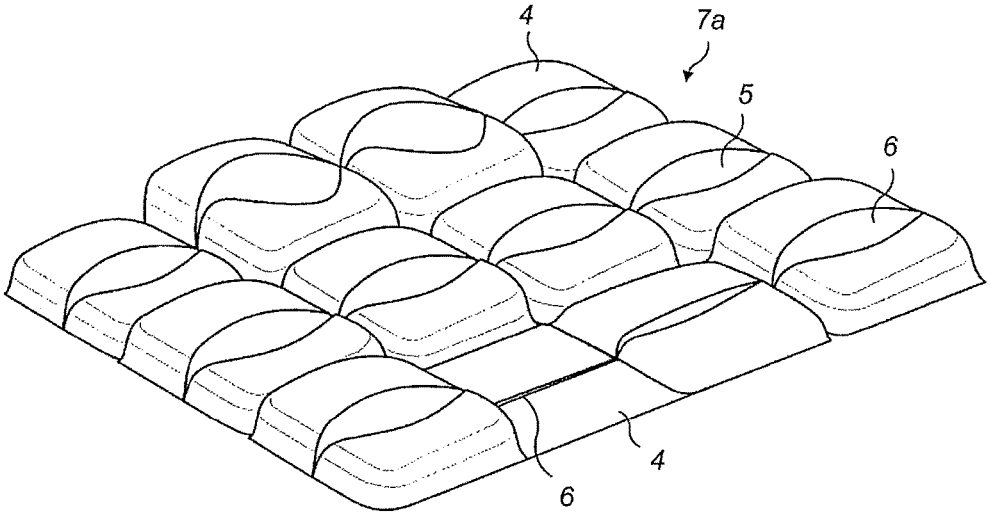
FIG. 2 is a schematic perspective view of FIG. 1 in which one or more inserts have been placed in some of the pockets on the substrate.
Figure 3:
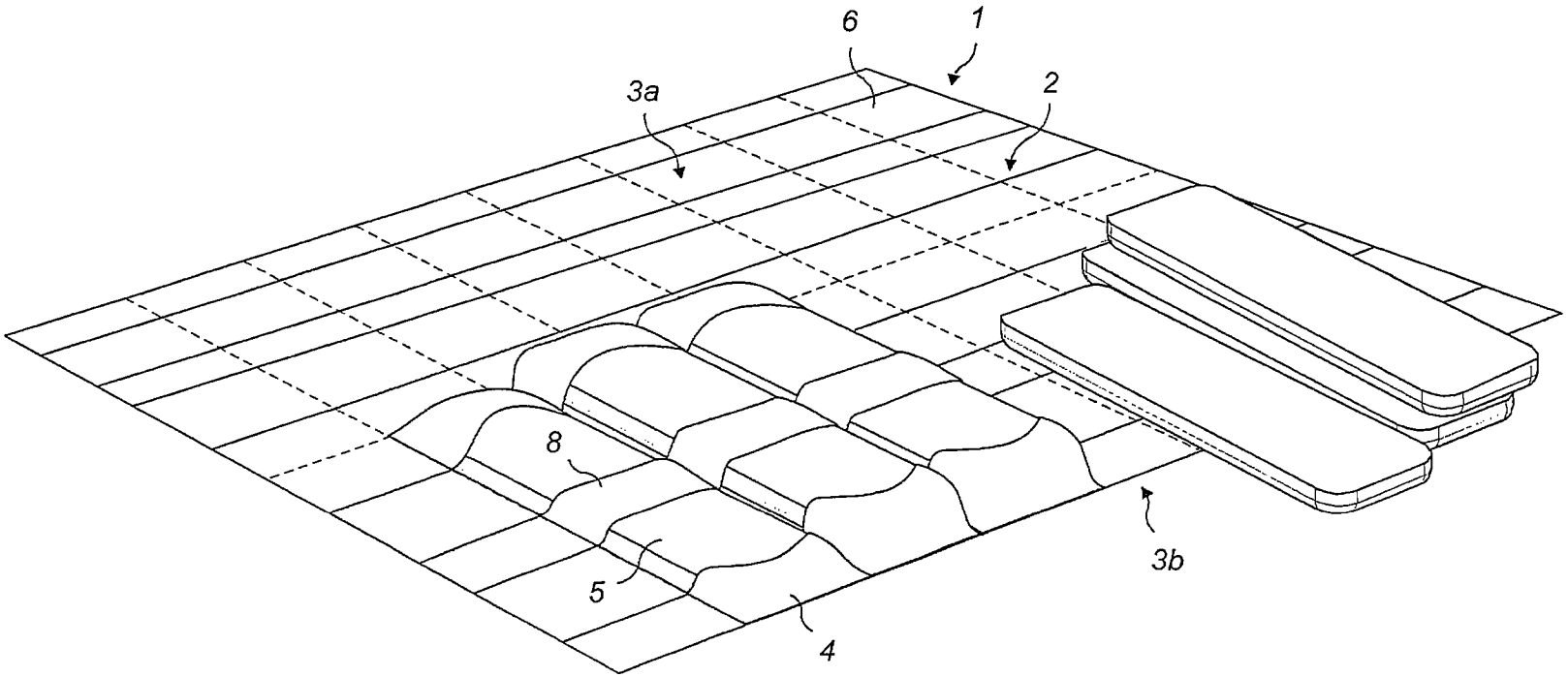
FIG. 3 is a schematic perspective view of another form of substrate for a contouring device according to the invention and in which one or more inserts have been placed in some of the pockets on the substrate.
Figure 4:
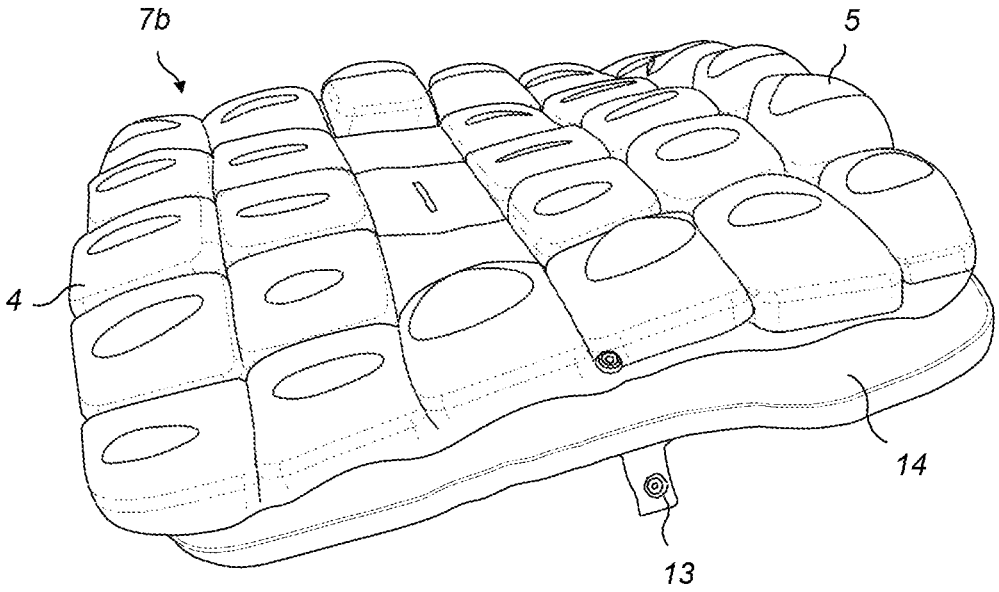
FIG. 4 is a front perspective view of a substrate with inserts that is placed behind a cushioning layer according to one form of the invention.
Figure 5:
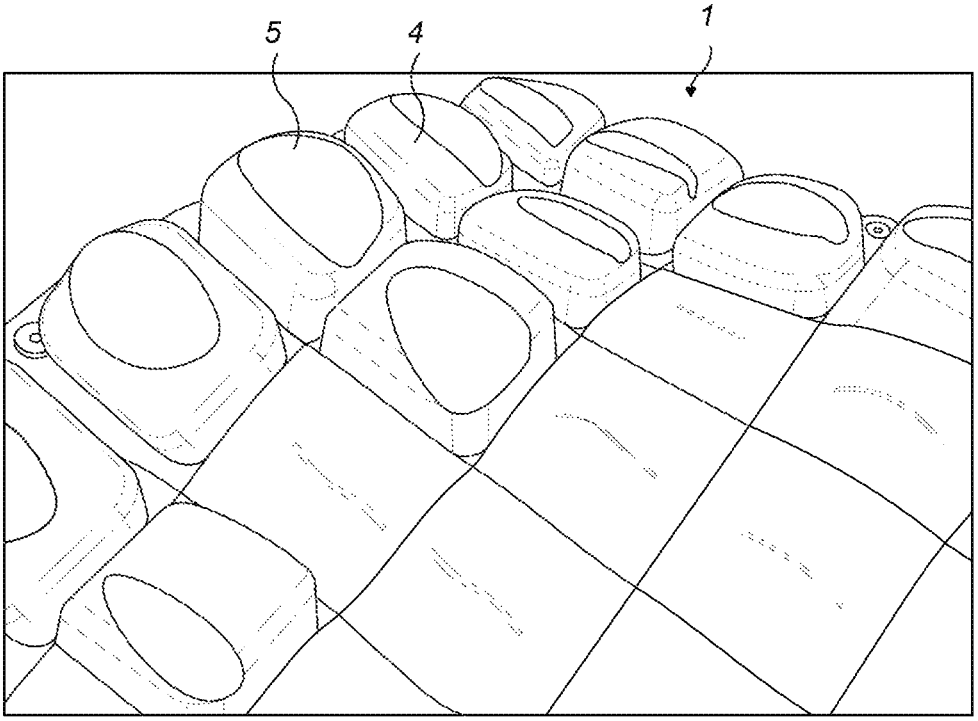
FIG. 5 is a close up front perspective view of a substrate with inserts in which it can be seen that the pockets are deformed by the inserts to form a contouring surface.

In one form, as shown in FIGS. 1 and 2, the at least one opening 6 within each pocket is in the form of a slit, but in other embodiments, the opening may be of any suitable shape. The at least one opening may also be formed at any suitable location in the pocket to allow one or more inserts to be placed within and removed from the pocket. For example, the opening may be located substantially at the centre of the pocket or at one side of the pocket. In another form, the opening may comprise a gap located between opposing substantially enclosed ends of the pocket. Optionally, a strap 8 extends across at least a portion of the gap to further restrain one or more inserts within the pocket, as shown in FIG. 3.

Multiple inserts 5 can be inserted through the at least one opening and held within each pocket, such as by stacking the inserts on top of each other. The inserts can be of any suitable regular or irregular shape and size to fit within the pockets. For example, the inserts may be oval, square, circular, rectangular, or hexagonal. In the embodiments shown in FIGS. 1 to 7, each insert is a rectangular prism shape, but the shape is distorted when the inserts are pushed into the pockets. Inserts of different shapes and sizes may be selected to be placed within selected pockets of the device. For example, one or more inserts may be of different thicknesses to others. In another example, where the device is used in a seat base, large rectangular pockets and corresponding large rectangular inserts may be used in the areas of the device on which a user's thighs would be positioned when the seat is in use. Alternatively, the inserts may be in the shape of wedges. These inserts are particularly suitable when the device is used in a seat base and the legs of the user need to be pushed inward toward the centre of the seat, or outward from the centre of the seat, for the user to obtain a comfortable and safe seated position. For example, the wedge-shaped inserts may be positioned in the device to form a contoured seat base having a raised area that extends along the outside of a user's thigh. When the user's thigh presses against this raised area, the user's thigh is caused to roll toward the centre of the seat. If this arrangement is used on both sides of the seat base, the user's thighs can be caused to rest side by side in the central area of the seat base.

In most forms of the invention, the inserts will be shaped to correspond with the pockets of the system, although this will not always be the case. For example, it may be necessary to fold a large insert in half and fit it within a smaller pocket to achieve the desired contouring effect.

The inserts can be made from any suitable material that can substantially retain its shape under pressure, regardless of the cushioning characteristics of the material. Preferably, the inserts are made of a cushioning material, such as a foam or rubber for example. However, in other forms, the inserts may be used to provide contouring alone, without cushioning. For example, the inserts may be formed of firm foam, a suitable plastic, or an air insert. Where the inserts are not made from a cushioning material, the device is suitable for use beneath a cushioning layer, such as a seat cushion or backrest cushion, to give comfort to the user. The cushioning layer may be any form of flexible material that can substantially mould around the first surface of the substrate and that has a cushioned contact surface.

In one form, as illustrated, the inserts are made from a soft foam material that provides both contouring and cushioning to the device. In this form, the device may be used as a cushioned and contoured seat base or backrest. Furthermore, if a cushion is placed on the device (whether the device is used in a backrest or seat base), the inserts provide an additional layer of cushioning to the seat.

In another form, the first contouring surface of the device comprises one or more hook or loop fasteners to which one or more pads with corresponding loop or hook fasteners can be removably attached to further enhance the contouring capabilities of the device.

To adjust the contouring device of the invention to suit a particular user, the needs of the user are first identified. A person then selects the pockets within which inserts are to be positioned and places a selected number of inserts of a selected size and shape within these pockets to modify the thickness of the device at selected areas. As inserts are placed within selected pockets, the contours of the exterior surfaces of the pockets change. In this specification, the exterior surface provided by pockets located on the first surface of the substrate is referred to as the first contouring surface 7*a* and the exterior surface provided by pockets located on the second surface of the substrate is referred to as the second contouring surface 7*b*.

It is possible to arrange the inserts within the pockets of the device so that one or more pockets contain no inserts, one or more other pockets each contain one insert, and one or more other pockets each container thicker or multiple inserts stacked on top of each other, as shown in FIGS. 1 to 6.

Without inserts, the device is of a regular shape and thickness, but when inserts are held within one or more pockets, the pockets start to bulge, causing the respective contouring surface 7*a*, 7*b* to become deformed/contoured so that some areas of the device become thicker than others. By varying the thickness of the device (i.e. varying the distance between the first and second contouring surfaces), a greater or lesser degree of contouring can be obtained.

The extent of contouring can be modified by adding inserts or using thicker inserts within selected pockets and by removing inserts from selected pockets or replacing selected inserts with thinner inserts.

To maximise the extent of contouring, inserts can be placed within directly opposing pockets located on the first and second surfaces 3*a*, 3*b* of the substrate. For example, if two inserts are placed within a pocket at the bottom left corner of the first surface of the substrate and one insert is placed in the opposing pocket at the bottom right corner of the second surface of the substrate, the contouring effect in this area of the substrate is greater than if the bottom right corner pocket of the second surface did not hold an insert. The contouring effect of this arrangement is substantially equal to the effect of placing three inserts in the bottom left corner of the first surface of the substrate.

Figure 9:
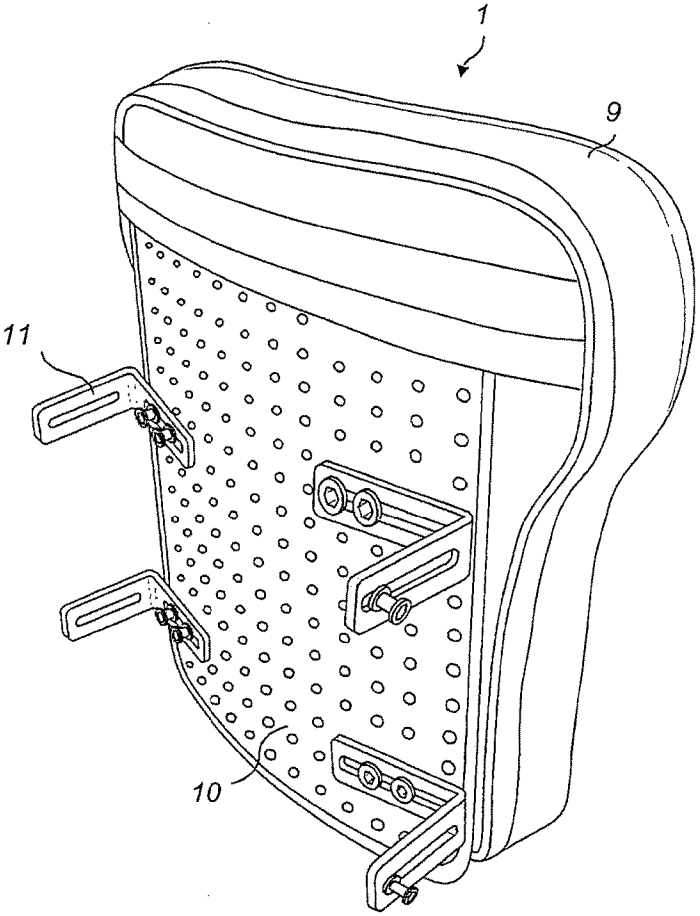
FIG. 9 is a rear perspective view of the device of FIG. 8.
Figure 8:
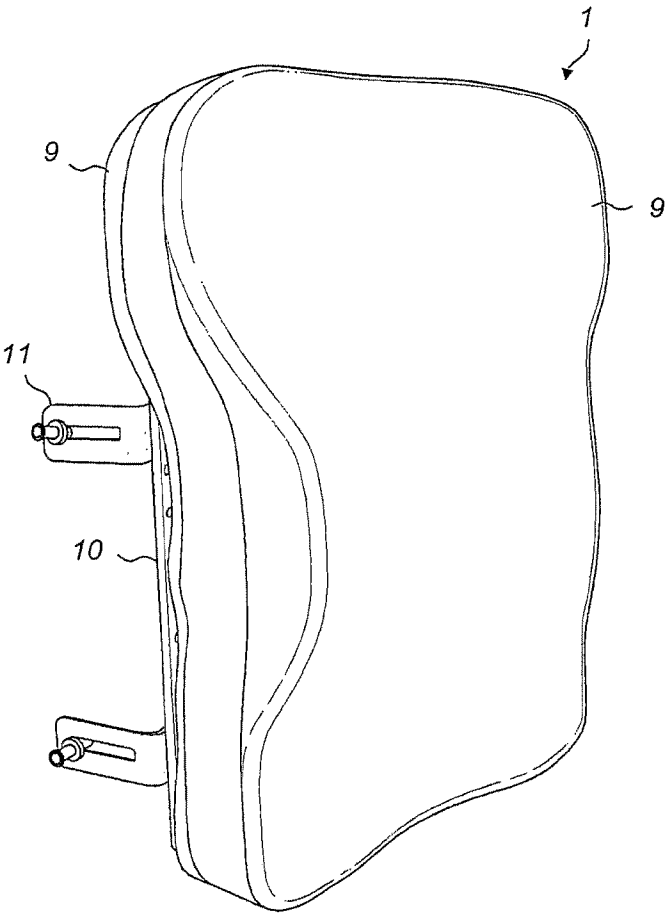
FIG. 8 is a front perspective view of the device of FIG. 7 in which a re-closeable opening of the cover is closed.

In FIGS. 6 to 9, the device is shown when used in the backrest of a wheelchair, but the device could otherwise be used in a seat base of a wheelchair or in any other type of seat or mattress. The wheelchair itself is not shown, but it will be appreciated that the backrest attaches to a wheelchair frame by way of rear brackets 11. As shown in FIGS. 7 to 9, the backrest comprises a weight bearing rigid back plate that forms a rear panel 10 against which the device 1 can be placed. When the second contouring surface 7*b* is placed against a firm or rigid panel of a backrest or seat base and a user presses against the panel, the second contouring surface moulds itself to the shape of the panel to some extent, which increases the contours of the first contouring surface as the high regions are pushed further away from the panel and the low regions are pushed toward the panel.

The extent of contouring may also be increased by layering multiple substrates on one another, each substrate having pockets and inserts to provide contouring, as described above. In this form, the substrates may be attachable to each other via removable fasteners, such as domes, hook and loop fasteners, hook and eye fasteners, and the like.

Optionally, the contouring device also comprises a cover 9 that covers at least the first contouring surface 7*a* of the substrate and that is fitted snugly so that the cover substantially moulds around the contours of this surface. The areas of the device that are thick form raised areas in the contact surface of the cover. Conversely, the areas of the device that are thin form low areas in the contact surface of the cover.

In one form, the device comprises a flexible cushioning layer that is placed on the first contouring surface of the substrate and a cover substantially encloses the substrate and cushion. In another form, the cover itself provides a cushioning layer. In each arrangement, the cover adopts contours that substantially correspond to the contours of the first contouring surface.

Preferably, as shown in FIGS. 7 to 10, the contouring device comprises a cover 9 that substantially encloses the substrate and that comprises an access opening 12 to allow access to the substrate so that inserts can be added to or removed from the pockets. For example, the access opening of the cover may be a re-closeable opening in the form of a zip or hook and loop fasteners. In the embodiment shown in FIG. 7, the contouring device is positioned in front of a rear panel of a backrest for a wheelchair and comprises a cushioning layer 14, which is placed on the first contouring surface of the substrate. The cover 9 substantially encloses the cushioning layer 14 and the substrate 2.

In one form, a flexible cushion comprising a sheet-like layer of padding (such as foam padding) and having a contact surface and a back surface is positioned so that the back of the cushioning layer 14 is placed over the first contouring surface of the substrate 2. The cushioning layer 14 is sufficiently flexible to substantially mould itself around the first contouring surface so that the contours of the first contouring surface are adopted by the cushion 14. The cushioning layer 14 provides further cushioning to the user and smoothens out any extreme bumps caused by the inserts 5 in the pockets 4. A cover 9 preferably encloses both the substrate 2 and the cushion 14.

Optionally, one or more pockets are provided on the back surface of the cushioning layer and each pocket is adapted to receive one or more inserts therein, as described above in relation to the pockets of the substrate and the inserts to be placed within the pockets.

To modify the contouring effect of a contouring device comprising a cover and a cushioning layer, the cover is opened and the cushioning layer is bent forward so that the pockets of the substrate can be easily accessed. Inserts are removed from and added to selected pockets as required. Where the device is used in a backrest, this procedure can be carried out when the user is sitting in the chair, simply by leaning the user forward in the chair and away from the backrest.

To increase the contouring of the contact surface of the cushioning layer, the cushioning layer may be removably attached to the substrate and/or to the rear panel of a backrest, seat base or bed base with fasteners 13, such as domes, a zip, hook and loop fasteners, or the like, so that the flexible cushioning layer is pulled firmly over the shape of the first contouring surface of the device, causing the cushion to mould around the shape of the first contouring surface. The thinner and more flexible the cushion, the more readily it moulds around the first contouring surface. This arrangement helps to improve the extent to which the thickness of the device translates into contouring of the cushioning layer. The areas of the substrate that are thick, translate into raised areas in the contact surface of the cushion. Conversely, the areas of the substrate that are thin, translate into low areas in the contact surface of the cushion.

In use, the contouring device is pressed against the rear panel of the backrest, seat base or bed as a result of the fasteners and/or pressure from the user sitting in the seat or lying on the bed, as the case may be. As the substrate is pushed against the substantially flat rear panel, the inserts in the pockets of the substrate are pushed forward from the rear panel to further deform the shape of the first contouring surface to provide increased contouring to the first contouring surface. If a flexible cushioning layer and/or cover is/are placed over the first contouring surface, the cushion and/or cover substantially moulds around the contours of the first contouring surface. This causes the contact surface of the cushion and/or cover to adopt contours that reflect the contours of the first contouring surface and the thickness of different areas of the device. In other words, the position of the inserts on the substrate, and the quantity, shape, and size of the inserts creates contours in the first contouring surface of the substrate and these contours are substantially adopted by the contact surface of the cushion and/or cover. The invention allows the position, quantity, shape, and size of the inserts to be readily modified to adjust the contouring of a seat or mattress according to the changing needs of the user, and to accommodate different uses and users.

Figure 10:
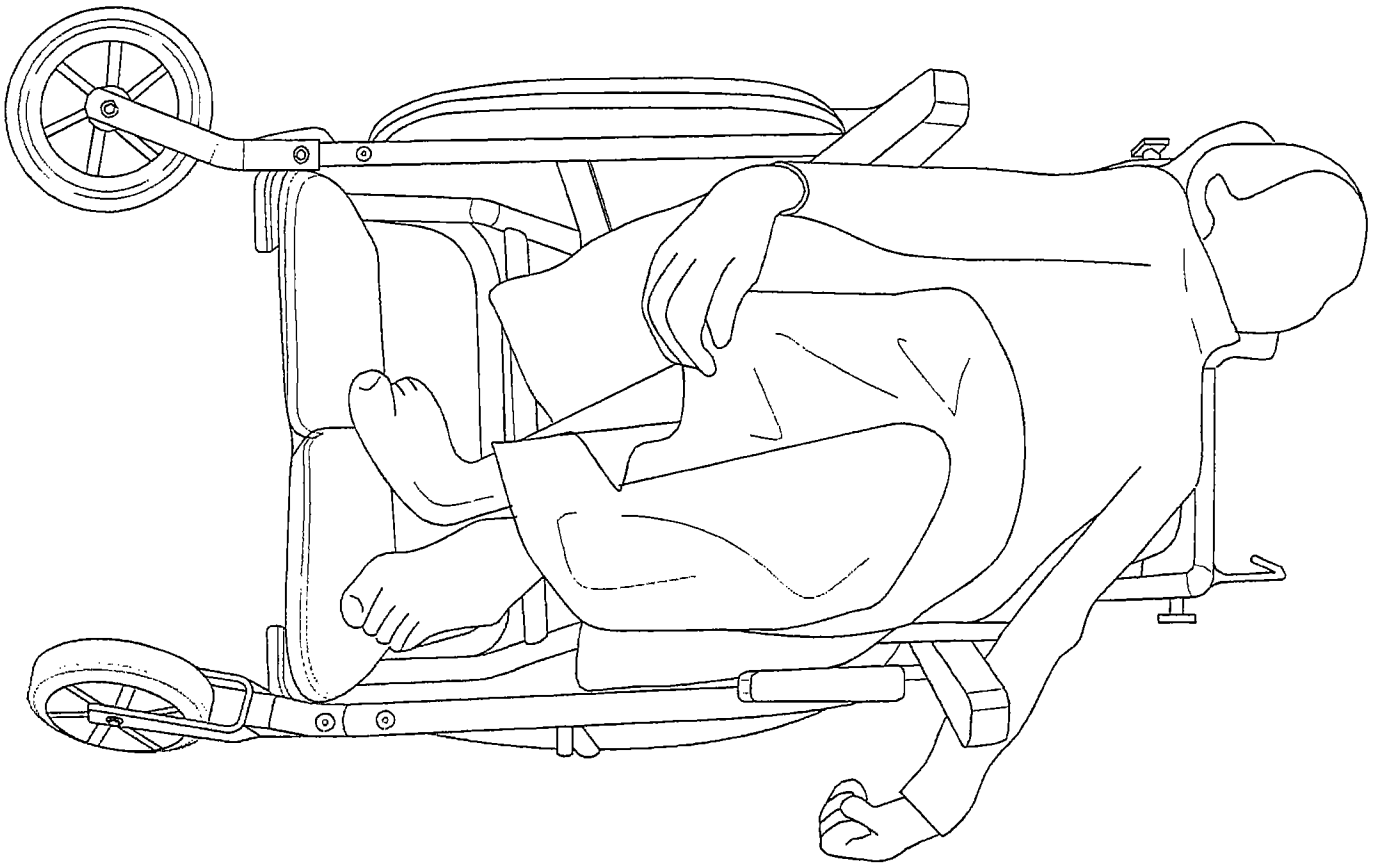
FIG. 10 is an image of a wheelchair user with asymmetrical posture seated in a wheelchair without the contouring device of the invention.
Figure 11:
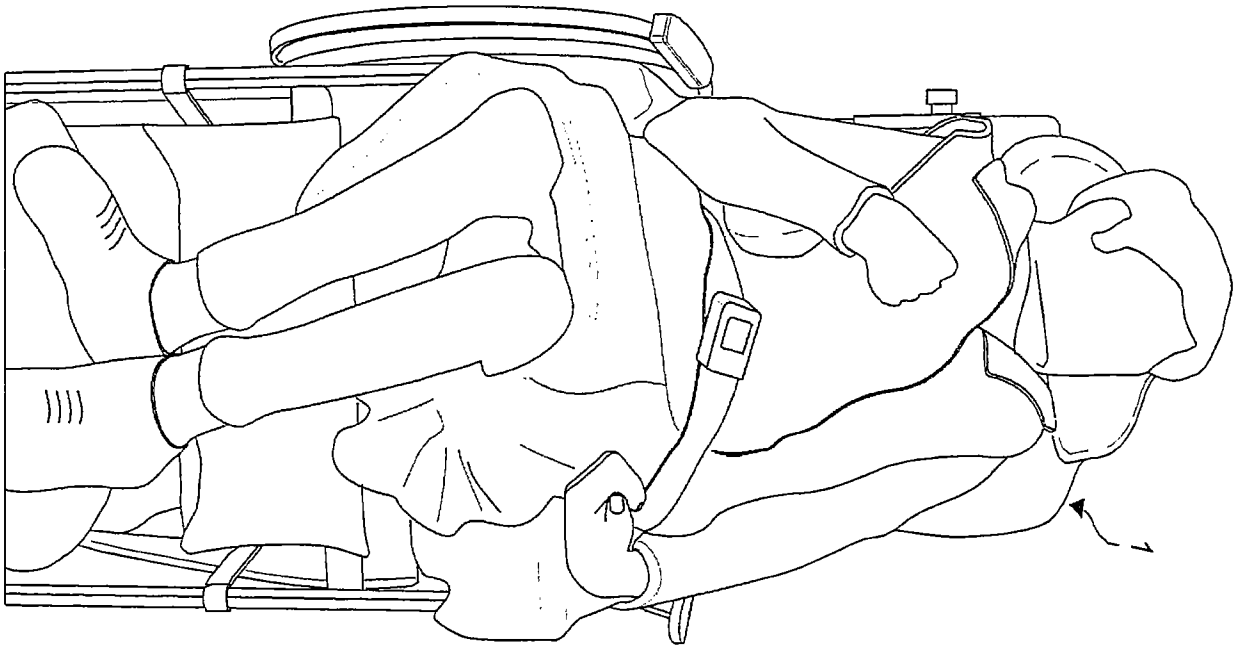
FIG. 11 is an image of the same user pictured in FIG. 10 after the wheelchair backrest has been fitted with the contouring device of the invention and the contouring has been adjusted to help correct the posture and seating position of the user.

A user with pronounced back asymmetry or protrusion can develop poor posture and can sometimes adopt unstable sitting positions, as shown in FIG. 10. The contouring device of the invention can be used to help rectify these problems. By using the device in a backrest and/or seat base, the contouring of the backrest and/or seat base can be modified to help accommodate and/or correct the seating position of the user. For example, as shown in FIG. 11, the contouring of the backrest has been adjusted to suit the needs of the user. A comparison between the images of FIGS. 10 and 11 shows the significant extent to which the contouring device of the invention has helped to correct the posture and seating position of the user.

Although the contouring device of the invention has primarily been illustrated and described for use in a backrest or seat base for a wheelchair, the contouring device of the invention may also be used with other types of seats, such as with a seat for a mobility device, a car seat, an aircraft seat, an office chair, couch, reclining chair, or arm chair. Alternatively, the device can be used as a mobile backrest that straps onto a seat.

Similarly, the contouring device may be used as a mattress for a bed or the device may be placed beneath or on top of a mattress. If the device does not comprise cushioning inserts, the device will always be placed beneath a cushioning layer.

The device is particularly useful in mattresses where the user has been bed ridden for a long time. In this situation, it is important that the user avoids pressure sores. Contouring in mattresses can also be important for postural reasons and particularly for managing body positioning when lying down. To help avoid pressure sores and/or to control body positioning, the contours of the device can be modified so that high areas of the device (thick areas) are created where certain areas of the user's body are intended to contact the device and to take the most pressure. In areas of the user's body where pressure is to be avoided, the device can be modified to provide recessed contours, such as by removing inserts from pockets at these areas and placing inserts within surrounding pockets.

Advantages

The contouring device of the invention allows for the contours of backrests and seat bases of seats to be readily modified to suit the needs of the person sitting in the seat. The contouring device provides an easily accessible way of modifying the contours of contact surfaces of the backrests and seat bases to varying degrees. Thus, the contouring device avoids the need to manufacture specially designed backrests and seat bases for users. In addition, the contouring device allows the same seat to be adjusted to suit the needs of a user as those needs change over time.

The contouring device also allows the same seat to be adjusted to suit the needs of different users over time. In other words, the contouring device provides a sustainable solution whereby the seating can be reissued to another user and the contouring can be readily modified to suit the needs of that new user.

Similarly, the contouring device allows for the contours of mattresses to be readily modified to suit the needs of the person lying on the mattress, by readily modifying the device to include raised areas (points of high pressure) and recessed areas (points of low pressure) according to the needs of the user.

Although the invention has been described by way of example, it should be appreciated that variations and modifications may be made without departing from the scope of the invention as defined in the claims. Furthermore, where known equivalents exist to specific features, such equivalents are incorporated as if specifically referred in this specification.

What we claim is:

1. A customizable backrest support comprising:

a substrate comprising a first surface and an opposing second surface facing away from the first surface, wherein the first surface comprises a plurality of first surface pockets, wherein the second surface comprises a plurality of second surface pockets, and wherein each of the first surface pockets defines an opening that faces away from an opening of each of the second surface pockets, one or more removable inserts held within one or more of the pockets, wherein the one or more inserts are formed from a cushioning material; and a cover that encompasses the substrate and that comprises a recloseable opening providing access to the one or more contouring inserts; wherein contours of the backrest support are determined at least in part by the number, thickness, shape, and location of the removable inserts in the first surface and second surface pockets of the substrate and wherein the number, thickness, shape, and location of the removable inserts in the first surface and second surface pockets of the substrate affect the postural support that the backrest support provides to a user with significant physical disabilities, wherein the one or more removable inserts help the user to sit comfortably and safely in a wheelchair whereby properly supporting the user's posture and positioning.

2. The customizable backrest support according to claim 1, wherein at least one of the plurality of first surface pockets are formed from an elasticated material.

3. The customizable backrest support according to claim 1, wherein at least one of the plurality of first surface pockets comprises substantially enclosed opposing ends and a pocket opening formed between the opposed ends of at least one of the plurality of first surface pockets.

4. The customizable backrest support according to claim 1, further comprising a cushioning layer located on the first surface of the substrate.

5. The customizable backrest support according to claim 4, wherein the cushioning layer comprises one or more fasteners for removably attaching the cushioning layer to the substrate.

6. The customizable backrest support according to claim 5, wherein the cushioning layer comprises one or more fasteners for removably attaching the cushioning layer to a rear panel of a backrest, seat base, or bed.

7. A backrest comprising the customizable backrest support according to claim 1.

8. A wheelchair having the customizable backrest support according to claim 1 attached to the backrest of the wheelchair.

9. The customizable backrest support according to claim 1, wherein at least one of the first surface pockets is opposed to at least one of the second surface pockets.

* * * * *